United States Patent [19]

Wheeler

[11] Patent Number: 4,644,726

[45] Date of Patent: Feb. 24, 1987

[54] STEEL PLACEMENT ASSEMBLY

[76] Inventor: Charles F. Wheeler, 6141 NW. 34th Way, Ft. Lauderdale, Fla. 33309

[21] Appl. No.: 835,292

[22] Filed: Mar. 3, 1986

[51] Int. Cl.[4] ..... E04C 5/16

[52] U.S. Cl. ..... 52/677; 52/687; 249/217

[58] Field of Search ..... 24/236, 237, 586, 685, 24/116 A; 52/687–689, 677; 249/30, 91, 86, 207, 216, 217

[56] References Cited

U.S. PATENT DOCUMENTS

| | | | |
|---|---|---|---|
| 946,779 | 1/1910 | Hubbell | 24/116 |
| 1,672,852 | 6/1928 | Roughan . | |
| 1,924,724 | 8/1933 | Olney . | |
| 2,194,834 | 3/1940 | Nealon . | |
| 3,114,221 | 12/1963 | Eriksson . | |
| 3,225,506 | 12/1965 | Aberg | 52/687 |
| 3,292,401 | 2/1965 | Van Meter | 24/231 |
| 3,300,930 | 1/1967 | Weise . | |
| 3,464,661 | 9/1969 | Alesi, Jr. . | |
| 3,471,987 | 10/1969 | Yelsma | 52/689 |
| 4,060,954 | 12/1977 | Liuzza . | |

FOREIGN PATENT DOCUMENTS

| | | | |
|---|---|---|---|
| 1484980 | 1/1969 | Fed. Rep. of Germany | 52/677 |

*Primary Examiner*—William F. Pate, III
*Assistant Examiner*—Dan W. Pedersen
*Attorney, Agent, or Firm*—Karen M. Gerken; Martin P. Hoffman; Mitchell B. Wasson

[57] ABSTRACT

A steel placement assembly comprising a plurality of steel placement lock members which mate to form circular cavities for supporting and retaining steel reinforcing bars along their transverse length and intermediate their ends in a concrete structural member. Mated pairs of vertically and horizontally oriented steel placement lock members cooperate with vertically and horizontally oriented adjacent mated pairs and with spacer members to form structural members of diverse size. The steel placement lock members are provided with extensions which positively maintain the reinforcing steel a sufficient distance inside the face of the concrete. Steel end lock members provided over the ends of the reinforcing bars prevent lateral movement of the bars toward the concrete face.

17 Claims, 12 Drawing Figures

FIG. 9.
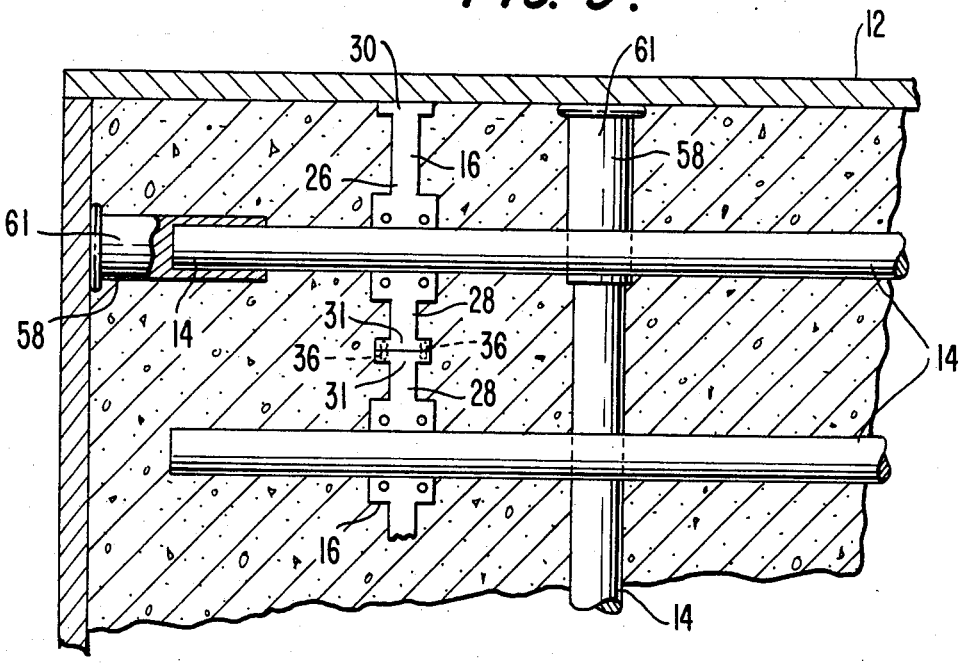
FIG. 10.
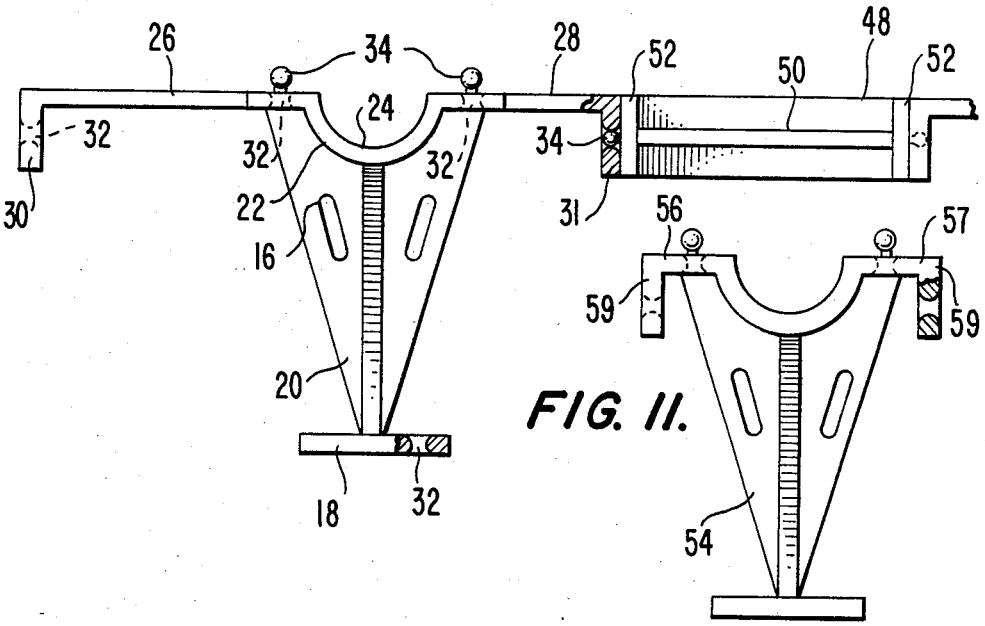
FIG. 11.

STEEL PLACEMENT ASSEMBLY

BACKGROUND OF THE INVENTION

1. Field of the Invention

The present invention is directed to apparatus for the placement of reinforcing steel in a variety of concrete structural members.

An essential aspect of reinforced concrete design involves the accurate placement and support of reinforcing steel bars in a concrete structural member. It is crucial that the reinforcing steel be precisely located and supported an adequate distance inside the face of the concrete. Failure to maintain the reinforcing steel a sufficient distance inward of the face of the concrete results in undesirable oxidation of the steel, necessitating very costly and extensive restoration of the structural member. The steel placement assembly of the present invention overcomes the problem of oxidation by accurately locating the steel reinforcement the optimum distance inside the concrete face.

The integrity of a concrete structural member is further determined by how effectively the reinforcing steel bars are locked into position within the concrete form to prevent unwanted shifting of the steel when the concrete is placed. The subject steel placement assembly prevents undesirable movement of the steel from design parameters and thereby enhances the ability of architects and engineers to design more efficiently. The attributes in design and placement of the reinforcing steel realized through utilization of the instant invention result in lower costs of construction and maintenance for reinforced structural members.

2. Prior Art

Several prior art patents are directed to supports or chairs for concrete reinforcing members. For example, U.S. Pat. No. 4,060,954 discloses a bar chair comprising a body member having tubular depending legs which snap onto the upwardly extending outer studs provided on the upper surface of an identical body member. Inside studs on the upper surface of each body member cooperate with the outer studs to retain various sizes of reinforcing bars.

U.S. Pat. No. 2,194,834 discloses a reinforced concrete stool comprising an upper section which fits over a lower section that has formed therein a notch for receiving a reinforcing rod. Similarly, U.S. Pat. No. 1,672,852 shows a support for a concrete reinforcing member consisting of a flat base and an upright body having a bifurcation in its upper end for supporting a reinforcing member in proper relation.

Components for the horizontal and vertical spacing of tubular members are also known in the prior art. U.S. Pat. No. 3,464,661 is directed to a conduit spacer apparatus comprising identical spacer members which mate to form a plurality of recesses for retaining tubular conduit. Each spacer is provided with upwardly projecting tongues and downwardly opening tongue receiving receptacles. The upwardly projecting tongues of one spacer member are inserted into the receptacles of the spacer member to which it mates.

None of the prior art patents discloses an apparatus which is capable of positively locating and supporting reinforcing steel a desired distance within the face of the concrete. Furthermore, the prior art fails to provide a device which accurately locates the reinforcing steel to prevent undesired movement while the concrete is being placed. The present invention accomplishes the foregoing objectives while being adaptable to produce structural members of diverse sizes which require various reinforcement positions.

BRIEF DESCRIPTION OF THE DRAWINGS

FIG. 9 is a plan view of a foundation or slab showing the steel placement lock members and the steel end lock members.

FIG. 10 is a front view of a steel placement lock member as it appears when connected to an elongated spacer member, only the lower half of the elongated spacer member being shown.

FIG. 11 is a front view of a center steel spacer member.

SUMMARY OF THE INVENTION

The invention is directed to a steel placement assembly which positively retains and supports steel reinforcement in a concrete structural member. A reinforcing steel bar is supported along its transverse length intermediate its ends by a pair of identical steel placement lock members. One of said steel placement lock members is inverted with respect to another of said members to form a mated pair defining a circular cavity for accommodating a bar of reinforcing steel. The mated pair is rigidly connected by ball members received within corresponding sockets. A steel connector member may be utilized when additional strength is required. The mated pair of steel placement lock members is provided with aligned first extensions having first vertical flanges forming a surface abutting the concrete form. These first extensions insure that the reinforcing steel is maintained at least 1½ inches inside the face of the concrete. A mated pair of steel placement lock members cooperates with like mated pairs to form structural members of diverse sizes. Horizontally and vertically adjacent mated pairs are connected to each other by a double-ended ball pin. The horizontal and vertical spacing of the reinforcing bars, and the dimensions of the steel placement assembly, may be varied by utilizing spacer members in conjunction with the steel placement locks. Lateral shifting of the reinforcement is prevented by providing steel end lock members on the ends of the reinforcing bars.

DETAILED DESCRIPTION OF THE PREFERRED EMBODIMENT

Figure 1:
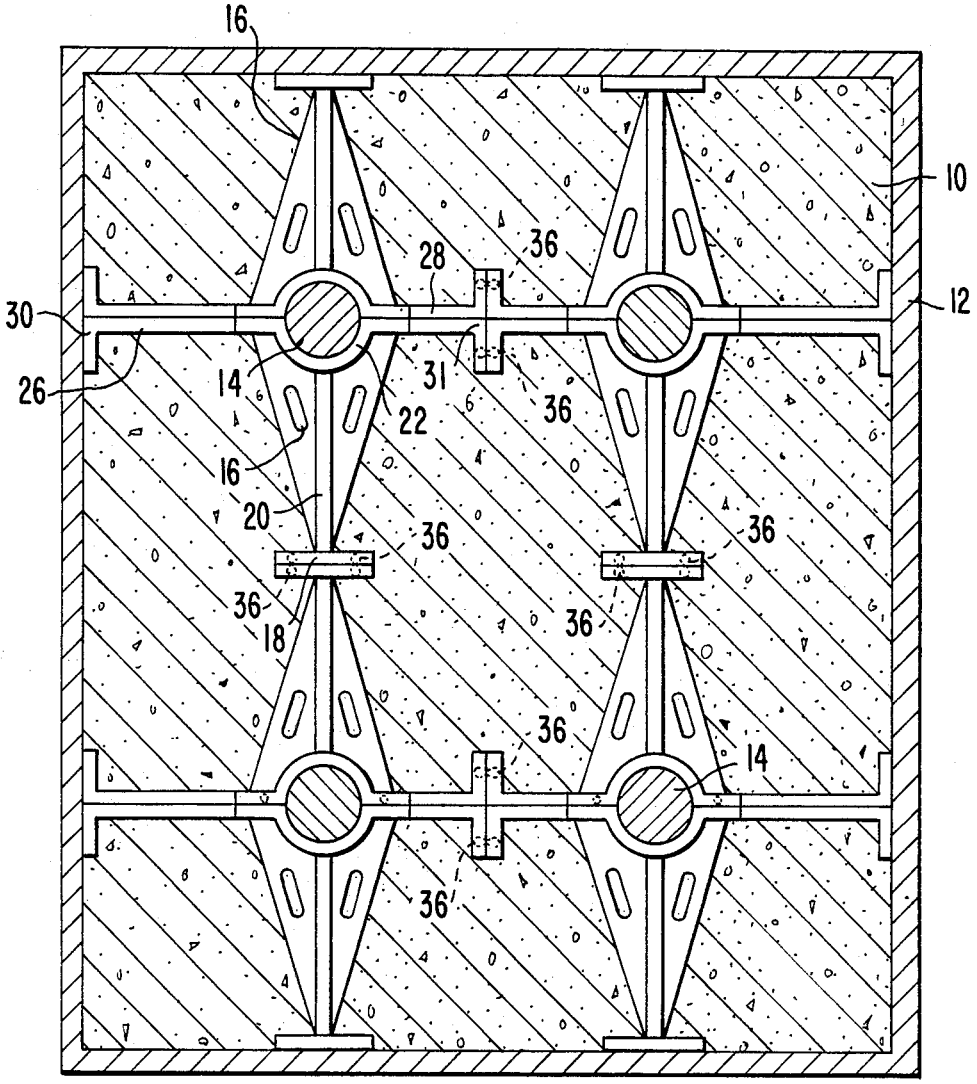
FIG. 1 is a front cross-sectional view through a concrete beam or column showing an assembly of the steel placement lock members.
Figure 4:
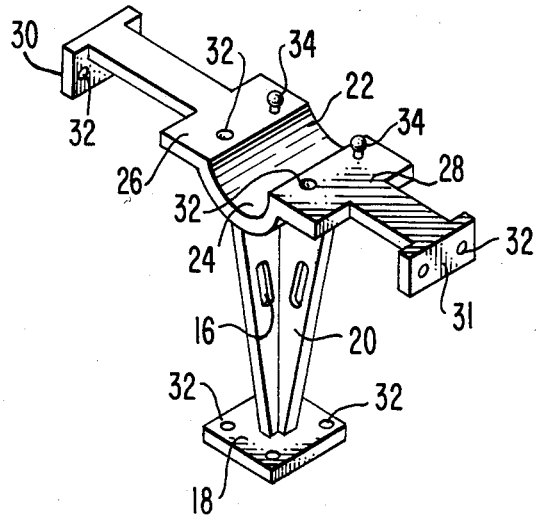
FIG. 4 is a perspective view of a steel placement lock member of the present invention.

FIG. 1 of the drawings illustrates a front cross-section view of a concrete structural member 10, such as a beam or column, as it appears prior to removal of the concrete form 12. The structural member 10 is provided with a plurality of steel reinforcing bars 14 which extend the transverse length of the concrete member. Each of the steel reinforcing bars is individually supported and retained along its transverse lengthened intermediate its end by a pair of identical steel placement lock members 16 which mate to form circular cavity for accommodating the steel. As best depicted in FIG. 4, the steel placement lock members of the present invention are preferably made from polyvinylchloride and comprise a flat planar base 18 from which upwardly extends a body portion 20. Body portion 20 terminates in a support surface 22 which defines a semicircular recess 24 in vertical alignment with the body portion. The first side edge of recess 24 terminates in an integral first extension 26 and the second side edge of recess 24 terminates in second extension 28. The first and second extensions 26, 28 are provided, respectively, with first and second integral vertically depending flanges 30, 31. A plurality of identical sockets 32 are formed in base 18 and in each of the vertically depending flanges 30, 31, the location of the sockets on each of the vertically depending flanges being identical. At least one socket 32 is formed in each of the first and second extensions 26, 28 proximate the recess. The location of the sockets on each of the first and second extensions is identical. Ball members 34, equal in number to the number of sockets, are provided on the first and second extensions and are located opposite to, but in the exact same location as, the sockets.

A pair of steel placement lock members 16 may mate together such that the semicircular recesses 24 form a circular cavity for supporting and locating a reinforcing steel bar 14 as depicted in FIG. 1. Thus, a steel reinforcing bar 14 is disposed within the semicircular recess 24 of a first steel placement lock member. A second steel placement lock member is inverted in relation to the first member such that the location of the ball members 34 and the sockets 32 provided on the extensions 26, 28 reverse. The ball members conform in size to the sockets such that each of the ball members snaps firmly in the socket to which it corresponds, thereby forming a rigid connection between the two steel placement lock members. The semicircular recesses 24 cooperate to define a circular cavity conforming in size to the diameter of the reinforcing steel. The lock members may be formed with recesses of diverse size so as to accept various sizes of reinforcing bars.

Figure 12:
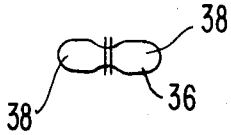
FIG. 12 is an enlarged front view of a double-ended ball pin.

Mated pairs of steel placement lock members cooperate with like mated pairs to create a complete steel placement assembly for all of the reinforcing steel in a structural member, as shown in FIG. 1 in connection with a beam or column. The mated pairs of steel placement locks are arranged within the concrete form such that the mated first vertically depending flanges 30 of the first extensions 26 form a surface which abuts the form and is tacked thereto. Said tacks may be provided through the sockets 32 formed in the first flanges 30. The planar bases 18 which are adjacent the concrete form 12 are similarly tacked thereto, as little securement is required to maintain the integrity of the system. The mated second vertically depending flanges 31 form a surface which abuts similarly mated second vertically depending flanges of the next horizontally adjacent, mated pair of steel placement lock members. The planar bases 18 of the steel placement lock members which are inward of the form abut planar bases of the next vertically adjacent steel placement lock members. Because the steel placement lock members are identical, the sockets 32 provided in abutting planar bases 18 and abutting second vertically depending flanges 31 will be in precise alignment. A double-ended ball pin 36, as shown enlarged in FIG. 12, is utilized to achieve a rigid connection through the aligned sockets of adjacent members. The double-ended ball pin comprises two integral balls 38, configured so as to snap in the aligned sockets formed in adjacent members and to positively retain the same, as can be seen in FIG. 1. A complete steel placement lock assembly may be provided as required at various locations along the transverse length of the reinforcing bars intermediate their ends.

Figure 2:
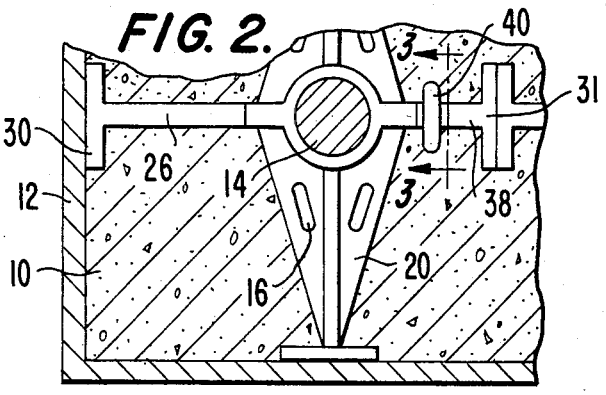
FIG. 2 is an enlarged portion of the front cross-sectional view of FIG. 1 showing the steel connector member.
Figure 3:
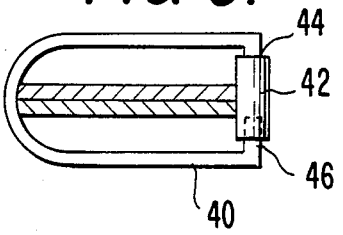
FIG. 3 is a side view, taken along line 3—3 of FIG. 2, of the steel connector member.
Figure 8:
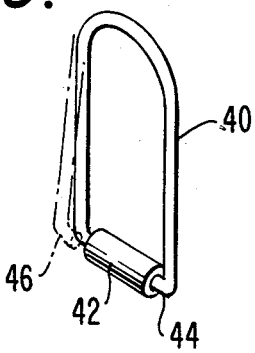
FIG. 8 is a perspective view of the steel connector member.

The mated pairs of steel placement lock members may also be connected to each other by a steel connector member 40, as illustrated in FIGS. 2, 3 and 8. The connector member comprises a hollow cylinder 42, a first end of which fixedly retains the first end of a U-shaped bar 44. The second end of the U-shaped bar is provided with an inwardly bent portion 46 which is adapted to be received in the second end of the hollow cylinder. The U-shaped member may be deflected outwardly as shown in FIG. 8 to remove the bent portion from the cylinder for placement of the connector member around the mated first and second extensions 26, 28. FIGS. 2 and 3 depict the connector as it appears snugly surrounding the aligned second extensions 28 of a pair of mated steel placement lock members with bent portion 46 being received within cylinder 42.

As can be seen in FIG. 1, the first vertically depending flanges 30 of aligned first extensions 26 forms a surface which abuts the concrete form 12, thereby locating the reinforcing steel inside the face of the concrete a distance equal to the length of the first extensions. In order to avoid the problem of potential oxidation, the reinforcement should be located $1\frac{1}{2}$ to 2 inches inside the face of the concrete. Thus, the first extensions 26, as measured from the first vertically depending flange 30 to the first side edge of recess 24 is $1\frac{1}{2}$ to 2 inches. Similarly, the distance from the planar base 18 to the semicircular recess 24 of each steel placement lock member is sufficient to maintain the reinforcing steel an adequate distance inside the face of the concrete. The length of the second extension 28 may vary depending upon the spacing required for the reinforcing bars.

Figure 6:
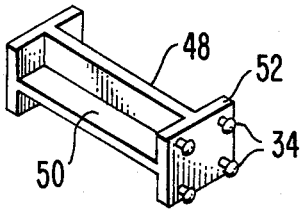
FIG. 6 is a perspective view of the elongated spacer member.

The steel placement lock assembly of FIG. 1 may be expanded in the vertical direction by simply aligning the planar bases of additional steel placement lock members with the planar bases of those members already in place. The assembly may be expanded in the horizontal direction by utilizing an elongated spacer member 48 between the aligned second vertically depending flanges 28 of horizontally adjacent members. As shown in FIGS. 6 and 10 of the drawings, the elongated spacer members comprises an elongated body 50 that terminates at each end in a planar flange 52 perpendicular to the body. Each of the planar flanges 52 is provided with a plurality of ball members 34 equal in number to, and having the same location as, the number of sockets 32 provided on the surface formed by mated second vertically depending flanges 31 of a pair of mated steel placement lock members. The ball members are configured to snap perfectly within said sockets. Thus, the horizontal distance between the reinforcing bars supported by two mated pairs of steel placement lock members may be increased by inserting an elongated spacer member 48 between the mated second vertically depending flanges 31 of horizontally adjacent steel placement lock pairs. FIG. 10 depicts a single steel placement lock member as it appears when connected to the elongated spacer member 48, only the lower half of which elongated spacer member is shown. Elongated spacer member 48 may be utilized in the same way to increase the vertical dimension of a steel placement assembly. The ball members 34 provided on each of said planar flanges 52 of the elongated connector member are equal in number and have the same location as the sockets 32 formed in the planar bases 18 of the steel placement lock members. By inserting the elongated spacer member between the aligned planar bases 18 of vertically adjacent steel placement lock members by snapping the ball members provided on the elongated spacer member into the sockets provided in the planar bases, any size beam or column may be formed.

Figure 5:
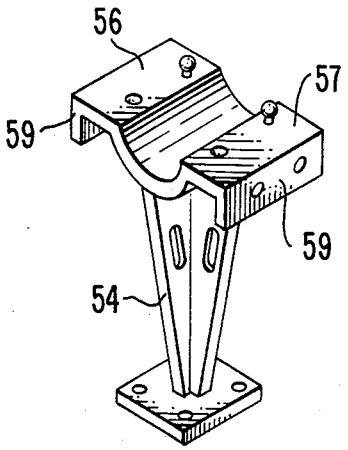
FIG. 5 is a perspective view of the center steel spacer member.

An alternative device for varying the horizontal location of the reinforcing bars is the center steel spacer member 54 shown in FIGS. 5 and 11. Center steel spacer member 54 is substantially identical to the steel placement lock members 16, varying only in the reduced and equal length of the first and second extensions 56, 57. As with steel placement lock members, a pair of center steel spacer members snap together by inverting one center steel spacer member in relation to another of said members to form a cavity for supporting and locating a reinforcing bar. A mated pair of center steel spacer members cooperate with a mated pair of steel placement lock members 16 for the surface formed by aligned second vertically depending flanges 31 of a mated pair of steel placement lock members is adapted to abut the surface formed by aligned vertically depending flanges 59 of a mated pair of center steel spacer members. The sockets provided in the respective abutting vertically depending flanges will be in perfect alignment and may be connected together by means of the double-ended ball pins. The center steel spacer member 54 may cooperate with spacer member 48, as previously discussed in connection with the steel placement lock members, to form a steel placement lock assembly of an size.

Figure 7:
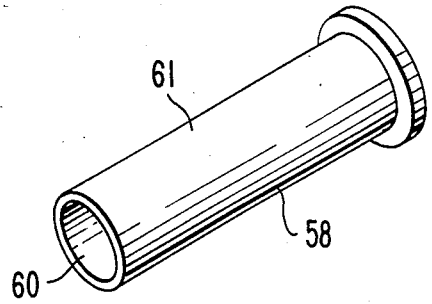
FIG. 7 is a perspective view of a steel end lock member.

In addition to the upward support for the reinforcing bars provided by the steel placement lock members, it is essential to provide lateral support for the steel to prevent the weight of the concrete as it is being placed from pushing the ends of the reinforcing steel bars toward the concrete form. Thus, the present invention contemplates not only supporting and locating the steel reinforcing bars 14 intermediate their ends along their transverse length by use of the steel placement lock members, but also preventing lateral movement of said bars by means of steel end lock members 58. FIG. 9 illustrates the steel end lock members being used in conjunction with the steel placement lock members in a concrete slab or foundation. As is best depicted in FIGS. 7 and 9, the steel end lock member 58 comprises a cylindrical polyvinylchloride body 61 having a channel on one end which receives the end of a reinforcing bar 14. The depth of the channel is such as to maintain the end of the reinforcing bar at least 2 inches inside the face of the concrete when the opposite end of the polyvinylchloride body is secured to the concrete form, thereby prohibiting lateral movement of the reinforcing bar.

It is to be understood that various modifications and changes may be made with respect to the foregoing detailed description without departing from the spirit and scope of the present invention. Thus, the appended claims should be liberally construed, and should not be restricted to their literal terms.

What is claimed is:

1. A steel placement assembly for positively locating and supporting reinforcing steel bars in a concrete structural member comprising a plurality of identical steel placement lock members, each of said steel placement lock members being provided with a flat planar base, a body portion extending upwardly from said base and terminating in a semicircular recess, a first side edge of said recess terminating in a first extension, a second side edge of said recess terminating in a second extension, said first and second extensions being provided respectively with first and second vertically depending flanges, a plurality of sockets formed in said second vertically depending flange, means for connecting at least one of said first and second extensions of a first steel placement lock member to the like extension of a second steel placement lock member when said first steel placement lock member is inverted in relation to said second steel placement lock member to form a mated pair of steel placement lock members, said recesses of said mated pair of steel placement lock members defining a circular cavity adapted to support and retain a steel reinforcing bar, said first vertically depending flanges of said mated pair forming a surface adapted to abut a concrete form, said mated second vertically depending flanges forming a surface adapted to abut the like surface formed by a horizontally adjacent like mated pair of second vertically depending flanges, such that said sockets formed in said abutting second vertically depending flange are aligned, means for connecting said abutting second vertically depending flanges, said horizontally adjacent mated pairs together forming a horizontal assembly adapted to support and retain a plurality of reinforcing bars along their transverse length and intermediate their ends, and means provided on said ends of said reinforcing bars for preventing lateral movement of said bars.

2. The steel placement assembly as recited in claim 1 wherein the length of said first extension, as measured from said first vertically depending flange to said first side edge of said recess, is at least ½ inches.

3. The steel placement assembly as recited in claim 1 wherein said means for connecting at least one of said first and second extensions of a first steel placement lock member to a like extension of a second steel placement lock member comprises at least one socket formed in each of said first and second extensions in the same location proximate said recess, at least one ball member provided on each of said first and second extensions, said ball members being equal in number to the number of said sockets provided in said first and second extensions, said ball members being located opposite to, but in the same location as said sockets such that the location of said ball members and said sockets provided on said first and second extensions reverse when said first steel placement lock member is inverted in relation to said second steel placement lock members, said ball members being adapted to snap into said sockets to form said mated pair of steel placement lock members.

4. The steel placement assembly as recited in claim 1 wherein said means for connecting at least one of said first and second extensions of a first steel placement lock member to a like extension of a second steel placement member comprises a hollow cylinder, a first end of said cylinder fixedly retaining the first end of a U-shaped bar, the second end of said cylinder removably retaining the second end of said U-shaped bar, said connector member being adapted to surround mated first and second extensions of said mated pair of steel placement lock members.

5. The steel placement assembly as recited in claim 1 wherein said means for connecting said abutting second vertically depending flanges includes a double-ended ball pin, said ball pin having a ball member at each end, said ball pin being adapted to be received within said aligned sockets of said abutting second vertically depending flanges.

6. The steel placement assembly as recited in claim 1 wherein said means for preventing lateral movement of said reinforcing bars comprises a cylindrical end lock member having a channel formed in one end, said channel terminating at least two inches inward from the opposite end of said end lock member, said channel being adapted to receive the end of said one of said reinforcing bars, said opposite end of said end lock member being adapted to be secured to a concrete form.

7. The steel placement assembly as recited in claim 1 wherein said steel placement lock members are made from polyvinylchloride.

8. A steel placement assembly for positively locating and supporting reinforcing steel bars in a concrete structural member comprising a plurality of identical steel placement lock members, each of said steel placement lock members being provided with a flat planar base, a body portion extending upwardly from said base and terminating in a semicircular recess, a first side edge of said recess terminating in a first extension, a second side edge of said recess terminating in a second extension, said first and second extensions being provided, respectively, with first and second integral vertically depending flanges, a plurality of sockets formed in said second vertically depending flange, at least one socket formed in each of said first and second extensions in the same location proximate said recess, and at least one ball member provided on each of said first and second extensions, said ball members being equal in number to the number of said sockets provided in said first and second extensions, said ball members being located opposite to, but in the same location as, said sockets such that the location of said ball members and said sockets provided on said first and second extensions reverse when a first of said steel placement lock members is inverted in relation to a second of said steel placement lock members, said ball members being adapted to snap into said sockets to form a mated pair of steel placement lock members when said first steel placement lock member is inverted in relation to said second steel placement lock member, said mated pair of steel placement lock members defining a circular cavity adapted to support and retain a steel reinforcing bar, said first vertically depending flange of said mated pair forming a surface adapted to abut a concrete form, said mated second vertically depending flanges forming a surface adapted to abut the like surface formed by a horizontally adjacent like mated pair of second vertically depending flanges such that said sockets formed in said abutting second vertically depending flanges are aligned, and means for connecting said abutting second vertically depending flanges, said adjacent mated pairs together forming a horizontal assembly adapted to support and retain a plurality of reinforcing bars along their transverse length and intermediate their ends.

9. The steel placement assembly as recited in claim 8 wherein the length of said first extension, as measured from said first vertically depending flange to said first side edge of said recess, is at least 1½ inches.

10. The steel placement assembly as recited in claim 8 wherein said means for connecting said abutting second vertically depending flanges includes a double-ended ball pin, said ball pin having a ball member at each end, said ball pin being adapted to be received within said aligned sockets of said abutting second vertically depending flanges.

11. The steel placement assembly as recited in claim 8 further comprising a connector member, said connector member adapted to secure at least one of said first and second extensions of a first steel placement lock member to a like extension of a second steel placement lock member, said connector member comprising a hollow cylinder, a first end of said cylinder fixedly retaining the first end of a U-shaped bar, the second end of said cylinder removably retaining the second end of said U-shaped bar, said connector member being adapted to surround mated first and second extensions of said mated pair of steel placement lock members.

12. A steel placement assembly for positively locating and supporting reinforcing steel bars in a concrete structural member comprising a plurality of identical steel placement lock members, each of said lock members being provided with a flat planar base, a body portion extending upwardly from said base and terminating in a semicircular recess, a first side edge of said recess terminating in a first extension, a second side edge of said recess terminating in a second extension, said first and second extensions being provided, respectively, with first and second integral vertically depending flanges, a like plurality of sockets formed in each of said first and second flanges, a plurality of sockets formed in said base, at least one socket formed in the same location on each of said first and second extensions proximate said recess, at least one ball member provided on each of said first and second extensions, said ball members being equal in number to the number of said sockets provided in said first and second extensions, said ball members being located opposite to, but in the same location as, said sockets such that the location of said ball members and said sockets provided on said first and second extensions reverse when a first of said steel placement lock members is inverted in relation to a second of said steel placement lock members, said ball members being adapted to snap into said sockets to form a mated pair of steel placement lock members when said first steel placement lock member is inverted in relation to said second steel placement lock member, said mated pair of steel placement lock members defining a circular cavity adapted to support and retain a steel reinforcing bar, said first vertically depending flanges of said mated pair forming a surface adapted to abut a concrete form, said mated second vertically depending flanges forming a surface adapted to abut the like surface formed by a horizontally adjacent like mated pairs of second vertically depending flanges such that the sockets formed in said abutting second vertically depending flanges are aligned, said surface formed by said mated second vertically depending flanges having said sockets formed therein in the same locations as said sockets are formed in said base, said mated pair being adapted to abut a vertically adjacent like mated pair at the location of said base such that the sockets formed in said abutting bases are aligned, and means for connecting said abutting second vertically depending flanges and said abutting bases, said adjacent mated pairs together forming a horizontal and vertical assembly adapted to support and retain a plurality of reinforcing bars along their transverse length and intermediate their ends in a horizontal and vertical spaced relation.

13. The steel placement assembly as recited in claim 12 wherein the length of said first extension, as measured from said first vertically depending flange to said first side edge of said recess, is at least $1\frac{1}{2}$ inches.

14. The steel placement assembly as recited in claim 12 wherein said means for connecting said abutting second vertically depending flanges and said abutting bases includes a double-ended ball pin having a ball member at each end, said ball pin being adapted to be received within said aligned sockets of said abutting second vertically depending flanges and said abutting bases.

15. The steel placement assembly as recited in claim 12 further comprising a connector member, said connector member adapted to secure at least one of said first and second extensions of a first steel placement lock member to a like extension of a second steel placement lock member, said connector member comprising a hollow cylinder, a first end of said cylinder fixedly retaining the first end of a U-shaped bar, the second end of said cylinder removably retaining the second end of said U-shaped bar, said connector member being adapted to surround mated first and second extensions of said mated pair of steel placement lock members.

16. The steel placement assembly as recited in claim 12 further comprising an elongated spacer member, said spacer member including an elongated body, said body having first and second ends, said first and second ends each terminating in a perpendicular flange, each of said flanges being provided with a plurality of ball members, said ball members being equal in number and having the same location as said sockets provided in said surface formed by said mated second vertically depending flanges, said ball members being adapted to snap into said sockets when said spacer member is disposed between said mated second vertically depending flanges of said horizontally adjacent mated pairs of said steel placement lock members, said ball members being equal in number and having the same location as said sockets provided in said base, said ball members being adapted to snap into said sockets provided in said base when said spacer member is disposed between said bases of said vertically adjacent mated pairs of said steel placement lock members.

17. The steel placement assembly as recited in claim 12 further comprising a center steel spacer member, said center steel spacer member comprising a flat planar base, a body portion extending upwardly from said base and terminating in a semicircular recess, a first side edge of said recess terminating in a first extension, a second side edge of said recess terminating in a second extension, said first and second extensions being provided, respectively,with first and second integral vertically depending flanges, said first and second extensions being of equal length, each of said first and second vertically depending flanges being provided with a plurality of sockets, said sockets being equal in number to, and having the same location as said sockets provided in said second vertically depending flange of said steel placement lock member, said center steel spacer member adapted to be inverted in relation to another of said center steel spacer members to form a mated pair, said mated pair of center steel spacer members defining a circular cavity adapted to accommodate a steel reinforcing bar, said sockets of said mated pair of center steel spacer members adapted to align with said sockets provided in said surface formed by said mated second vertically depending flanges of said mated pair of steel placement lock members when said mated pair of center steel spacer members is disposed between said mated second vertically depending flanges of said horizontally adjacent mated pairs of steel placement lock members.

* * * * *